US007810649B2

(12) United States Patent
Robertson

(10) Patent No.: US 7,810,649 B2
(45) Date of Patent: Oct. 12, 2010

(54) SIFTING SCREENS

(75) Inventor: Graham Alexander Robertson, Edinburgh (GB)

(73) Assignee: United Wire Limited (GB)

( * ) Notice: Subject to any disclaimer, the term of this patent is extended or adjusted under 35 U.S.C. 154(b) by 1076 days.

(21) Appl. No.: 10/584,670

(22) PCT Filed: Dec. 14, 2005

(86) PCT No.: PCT/GB2005/004814

§ 371 (c)(1),
(2), (4) Date: Aug. 18, 2006

(87) PCT Pub. No.: WO2006/064220

PCT Pub. Date: Jun. 22, 2006

(65) Prior Publication Data

US 2009/0139909 A1 Jun. 4, 2009

(30) Foreign Application Priority Data

Dec. 18, 2004 (GB) ..... 0427756.2

(51) Int. Cl.
*B07B 1/46* (2006.01)

(52) U.S. Cl. ..... 209/401; 209/403

(58) Field of Classification Search ..... 209/392, 209/397, 399, 400, 401, 403, 412
See application file for complete search history.

(56) References Cited

U.S. PATENT DOCUMENTS 4,674,251 A * 6/1987 Wolff ..... 52/309.15
5,950,841 A * 9/1999 Knox et al. ..... 209/315
6,006,923 A * 12/1999 Helmy et al. ..... 209/397
6,305,549 B1 * 10/2001 Riddle et al. ..... 209/403
6,672,460 B2 * 1/2004 Baltzer et al. ..... 209/403
6,759,000 B2 * 7/2004 Cook et al. ..... 264/279

* cited by examiner

*Primary Examiner*—Joseph C Rodriguez

(57) ABSTRACT

A frame over which woven wire mesh is to be stretched and secured to form a sieving screen and which can be used to screen solids from drilling mud recovered from down-hole when drilling for oil or gas. The frame comprises a rectilinear molded plastics frame having edge regions by which it is secured in place in a shaker. Within the frame is a plurality of rectilinear windows formed by an orthogonal array of intersecting ribs also of molded plastics material. Some of the ribs are internally reinforced by a structure comprising two spaced apart layers of orthogonal intersecting spaced apart wires, running parallel to the length and breadth of the rectilinear shape of the frame within the ribs to increase their rigidity. The edge regions of the frame are reinforced internally by metal box-section members joined at their four corners and defining perimeter reinforcement, and the ends of the wires are secured to the box-section members. The latter are encapsulated in the same plastics material from which the orthogonal array of intersecting ribs are molded. Alternate ribs are not reinforced with wires, and the non-reinforced ribs only extend partway between the upper and lower faces of the frame. Lengths of wire bent to form spacers and adapted to fit between upper and lower wires of the rib reinforcing structure, are joined to the upper and lower wires so as to extend therebetween and maintain the desired separation of the two layers of wires during the plastics encapsulation/molding process.

11 Claims, 10 Drawing Sheets

SIFTING SCREENS

FIELD OF INVENTION

This invention concerns sifting screens such as are fitted in shakers which are employed to separate solids from liquids, and in particular to separate solids from liquid drilling muds brought up from down-hole when drilling for oil or gas.

BACKGROUND TO THE INVENTION

Historically such screens have been constructed from sheets of woven wire mesh stretched over and secured to metal frames using a polymer adhesive. Typically the frames are generally rectangular and define one or more rectangular openings over which the wire mesh is stretched.

Usually two or more layers of wire mesh having different mesh sizes have been secured to each metal frame. The tensions in the warp and weft wires of one mesh are normally greater than the corresponding warp and weft wire tensions in the other mesh.

FORMS OF FRAME

Such constructions tended to result in relatively heavy screens and since they are typically man-handled into position a new design of frame was introduced some years ago by the Applicant Company. This was constructed largely from a GRP polymer moulding in which a wire-frame is embodied during the moulding process, to reinforce the final structure and introduce sufficient rigidity to not only contain and preserve the tensions in the wire meshes, but also to ensure that the frames did not bend under the weight of the relatively dense slurry making up the drilling mud and the build-up of solids on the screen in use.

This design of screen was ideally suited to shakers such as the VSM range of shakers supplied by Rig Technology Ltd. of Aberdeen, Scotland, UK.

The throughput of a shaker screen is dictated at least in part by the area of the screen mesh onto which the drilling mud is deposited in use. Since the area of each rectangular frame was dictated in part by the maximum permitted weight of the final screen, filtering areas greater than that of a single screen were created by arranging two or four screens in edge to edge abutment in a rectilinear rigid basket, having edge supports on which edges of the screens rested. The screens were held in place by clamps and preferably an inflatable clamping mechanism was employed to clamp the edge of the screens onto the edge supports of the rigid basket. The inflatable clamping also ensured a good liquid-tight seal around the edges of the screens.

Other shakers have been developed which accommodate large area but less well supported screens, and it has been proposed to construct such screens using wire-frame reinforced GRP frames, but after testing prototypes they were found not to have sufficient stiffness to perform in the field.

In particular the larger area GRP wire-frame reinforced screens were observed to whip violently around the centre of the unsupported span. This resulted in the screen becoming separated from edge supports to which it should remain sealed at all times in use. This allowed slurry to bypass the screen and drop into the sump reserved for filtered liquids.

In addition the whipping of the edge regions of the screen onto the edge supports resulted in damage to the underside of the screen frame.

Furthermore, excessive whipping caused considerable splashing of slurry over the walls of the basket and onto the floor on which the shaker was mounted. Quite apart from loss of relatively expensive drilling muds, the chemicals making up the muds are not such as should be dumped at sea. Therefore any such splashing could result in environmental contamination and serious penalties for rig-operators if any such spillages are not collected and disposed of correctly, all of which increased the cost of processing and recovering the down-hole mud.

It is therefore an object of the present invention to provide an improved form of relatively light-weight frame construction which is sufficiently rigid as not to whip excessively in use and can span larger screening areas than the previously produced wire reinforced GRP framed screens.

SUMMARY OF THE INVENTION

According to one aspect of the present invention a frame over which woven wire mesh is to be stretched and secured to form a sieving screen which can be used to screen solids from drilling mud recovered from down-hole when drilling for oil or gas comprises a rectilinear moulded plastics frame having edge regions by which it is secured in place in a shaker and defining a plurality of rectilinear windows formed by an orthogonal array of intersecting ribs also of moulded plastics material, wherein the ribs are internally reinforced by a structure comprising two spaced apart layers of orthogonal intersecting spaced apart wires, running parallel to the length and breadth of the rectilinear shape of the frame within the ribs to increase their rigidity, the edge regions are reinforced internally by metal box-section members joined at their four corners, and the ends of the wires are secured to the box-section members.

Preferably the box-section members are encapsulated in the same plastics material as forms the moulded orthogonal array of intersecting ribs.

In a preferred arrangement alternate ribs are not reinforced with wires and may only extend a short way between the upper face and underside of the frame, typically half way, and are referred to as half-height ribs.

Lengths of wire bent to form spacers and adapted to fit between upper and lower wires of the rib reinforcing structure may be welded or otherwise joined to the upper and lower wires, so as to extend therebetween and maintain the desired separation of the two layers of wires during the plastics encapsulation/moulding process. The spacers are wholly contained within the plastics material forming the ribs during the encapsulation/moulding process.

The rectangular perimeter of the resulting screen is therefore a substantial rigid structure which will not whip when vibrated in use in a shaker and is sufficiently strong to resist bending or deformation due to mesh wire tension and can span larger areas than the reinforced GRP screens previously developed for the Rig Technology VSM series of shakers.

In use the perimeter of the screen is sealed against a rectilinear seating within the shaker to prevent seepage of liquid therearound. The box-section reinforcement provides sufficient strength to eliminate the separation that can occur between the frame and the seating due to whipping, and will thus solve the fluid bypass and seal damage issues. The rigid perimeter also acts as additional support for the upper and lower wires of the internal wire grid structure, and this reduces the relative deflection of the grid of intersecting ribs to such an extent that excessive splashing will also be reduced if not eliminated.

The box-section members of the perimeter reinforcing frame may have a square or rectangular cross-section.

Preferably the ends of the two layers of wires are secured to the upper and lower faces of the square or rectangular cross section perimeter reinforcement.

The invention also lies in a framework for reinforcing a frame of plastics material over which woven wire mesh is to be tensioned and bonded to form a sieving screen, comprising two spaced apart layers of orthogonal intersecting spaced apart wires running parallel to the length and breadth of the rectilinear shape of the frame, and a rectilinear bounding sub-frame of metal box section members joined at their four corners to which the ends of the wires are secured.

In such a framework the ends of the wires in one layer are secured to the upper face of the sub-frame members and the ends of the wires in the other layer are secured to the underside of the sub frame members.

The invention also lies in a screen constructed from a frame as aforesaid having at least one layer of woven wire stretched over and secured to the upper surface of the frame so that tension is maintained in the wire cloth at the end of the manufacturing process.

Such a screen is typically clamped in position in a shaker basket using a pneumatic seal or by wedges driven into position between abutments protruding internally from the shaker basket and the upper face of edge regions of the screen.

The invention also lies in a screen as aforesaid when fitted in a shaker wherein the screen is clamped in position in a shaker basket using a pneumatic seal or by wedges driven into position between abutments protruding internally from the shaker basket and the upper face of edge regions of the screen.

The invention will now be described by way of example with reference to the accompanying drawings, in which:

FIG. 1 is an exploded perspective view of part of a known screen,

FIG. 2 is a scrap section of the upper end of one of the intersecting array of ribs in the known frame showing a reinforcing wire embedded in the moulded GRP material, FIG. 3 is a perspective view of the welded wire reinforcement grid employed in the manufacture of the known screen, FIG. 4 is a cross-section through one of the ribs of FIG. 1 showing both upper and lower wires, FIG. 5 is a cross-section through the outer perimeter of a frame constructed in accordance with the first aspect of the present invention, in which the box section is square, FIG. 6 shows one technique for securing a large area screen in a shaker, FIG. 7 is a perspective view of a metal reinforcing structure embodying the invention in which the perimeter reinforcing frame is of rectangular box section, and wires extend between opposite sides of the frame, FIG. 8 is a similar view of the completed screen after being encapsulated in a GRP material in which the near side corner is cut away to reveal the reinforcing wires and box section perimeter reinforcement, FIG. 9 is a similar view to that of FIG. 7 showing how the ends of the wires can be bent to embrace the box section, for welding thereto, FIG. 10 is an enlarged view of one corner of the reinforcing structure of FIG. 7, FIG. 11 illustrates how the box section is supported within a mould tool by C-clips, FIG. 12 shows how the open ends of the box section can be closed before moulding, FIG. 13 is a plan view of the reinforcing structure of FIG. 9, FIG. 14 is a cross section view on AA of FIG. 13, showing wire spacers in place, FIG. 15 is a detail of a spacer, FIG. 16 is a cross section on B-B of FIG. 13, FIG. 17 is a plan view from above of part of a frame after moulding in GRP but before wire mesh has been applied thereto, FIG. 18 is a part cross section of FIG. 17, FIG. 19 is an enlarged view of the left hand end C of FIG. 18, FIG. 20 is an enlarged view of the region D of FIG. 18, FIG. 21 is a part cross section on BB of FIG. 17 and, FIG. 22 is an enlarged view of region F of FIG. 21.

In FIG. 1 a known support frame is shown comprising a welded grid of reinforcing wires generally designated 10 (and best seen in FIG. 3) embedded in a moulded rectilinear structure defining an external rectilinear flange 12 and a grid of orthogonal intersecting ribs, two of which are denoted in FIG. 1 by 14, 16. Layers of woven wire mesh such as 19, 21, 23 are laid over, tensioned and secured to the frame in manner known per se.

The upper edges of the ribs 14, 16 are triangular in cross-section as best seen in FIG. 2 which shows the inner core of plastics material 18 embedding one of the upper layers of wires 20 and the smooth hard wearing outer skin of plastics material 22.

As best seen in FIG. 1 two wires extend through each rib, an upper wire 20 and a parallel lower wire 24.

The lower wires such as 24 are bent up and welded to the upper wires at opposite ends of each wire run, and (although not shown in FIG. 3) also along each of the two longer sides of the reinforcing framework, as depicted at 26. The double thickness of wire extending into the end and side flanges of the eventual frame have been found to provide sufficient rigidity to the flanges for the smaller area screens such as are employed in the Rig Technology Ltd VSM range of shakers.

FIG. 4 is a cross-section through the rib 16 of FIG. 1.

FIG. 5 shows how the flange 12 is replaced by a box-section reinforced frame in accordance with the invention. The metal box-section 32, may be square as shown but other cross-section shapes are possible such as rectangular or triangular. The box-section reinforcement of the outer frame members creates rigid non-flexing perimeter to the screen.

A method of securing the screen in a shaker basket 46 is shown diagrammatically in FIG. 6. Here the opposite side edges 48, 50 of a screen 52 are shown clamped between a lower supporting structure shown in dotted outline at 54, 56 and 58 which form a seating for the screen edges, and two blocks 64, 66 which protrude laterally inwardly from the inner faces of the sidewalls 68, 70 of the shaker basket. Two wedges 60, 62 are driven into position and wedged below blocks 64, 66 to secure the screen in place.

The rear wall of the basket is shown at 72 and a reduced height front wall is shown at 74. The latter provides support for one longer edge of the screen, while the seating part 56 provides support for the other longer edge of the screen.

The wedges 60, 62 ensure that the side edges of the screen are sealed to the seating parts 54, 58, but unless the screen structure is sufficiently rigid as to prevent flexing and whipping, the seal between the longer edges of the screen and the front and rear seating parts 74, 56 can be broken in use. This allows fluid to seep around the longer edges of the screen. The junction between two of the edges in question is shown at 76 in FIG. 6.

A screen which incorporates a reinforcing frame constructed in accordance with the present invention is shown in FIG. 10. In this frame upper and lower parallel layers of orthogonal intersecting wires such as 75, 77 extend between the four sides of a rectangular metal box section bounding member made up of four parts 78, 80, 82, 84. The ends of the wires are welded to the upper and lower surfaces of the box section parts members 78-84.

After moulding in suitable tooling, the wires and bounding member are encapsulated in plastics material, preferably a glass reinforced plastics material, to form a finished frame such as is shown in FIG. 11. As shown the frame is partly cut away to reveal the wires and parts 78 and 80 of the box-section bounding member.

FIGS. 9 and 10 illustrate how the ends of the wires can be bent so as to overlie the upper surface, and underlie the lower surface, of the box section. Two such wires are denoted by 86, 88, in FIG. 10, with the bent ends denoted by 90, 92.

The ends are welded to the box section as shown at 94.

The corners of the box-section member are butt joints which are welded as shown at 96 in FIG. 10 and 98 in FIG. 9.

Since the box-section is to be encapsulated by the plastics material, it is necessary for it to be stood-off from the inside of the mould tool, and to this end C-clips such as 100 are fitted at points around the box-section parts 78, 80 etc., as shown in FIGS. 11 and 12. In addition open ends of the box-section are plugged before moulding by means of plugs 102 as shown in FIG. 12. The latter may be of plastics material or metal.

FIG. 13 is a top plan view of the reinforcing structure of FIG. 9 to a reduced scale, and FIG. 14 is a cross-section on AA of FIG. 9 and shows two wire spacers 104, 106 positioned between upper and lower wires 108, 110 and welded thereto. The spacers prevent the inserts 108, 110 from buckling and collapsing under the moulding pressures, and may be provided along all the pairs of wires parallel to 108, 110 or simply along selected pairs of wires.

Figure 1:
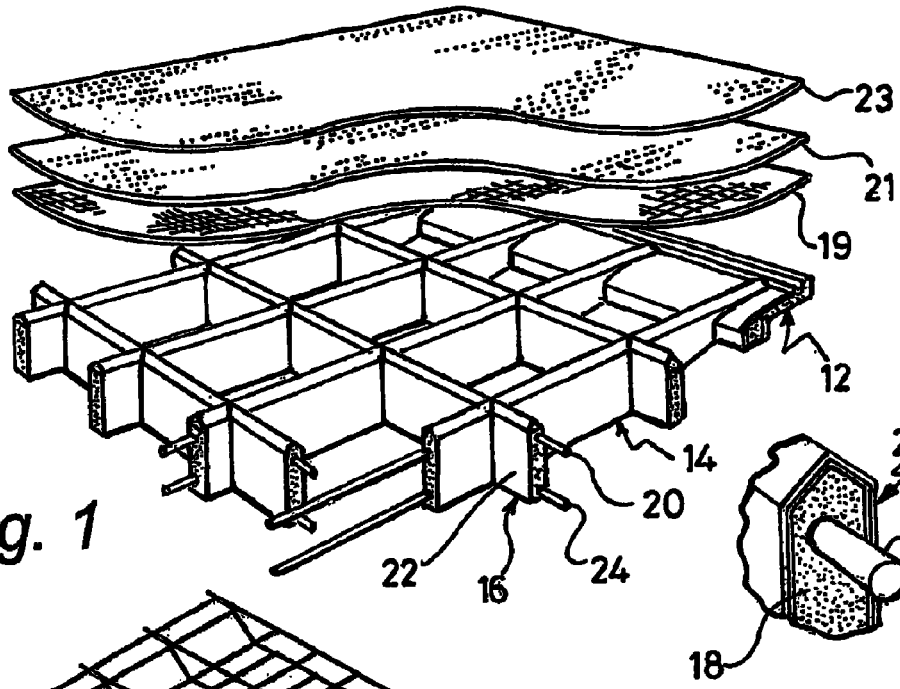
Figure 2:
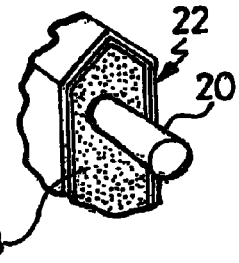
Figure 3:
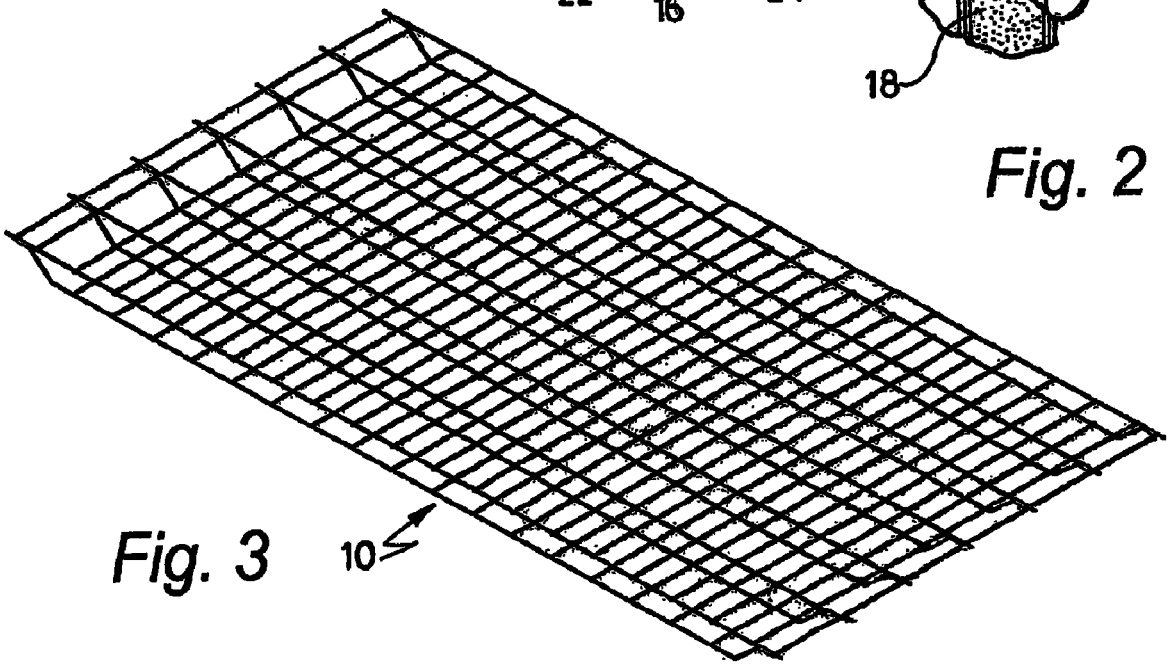
Figure 4:
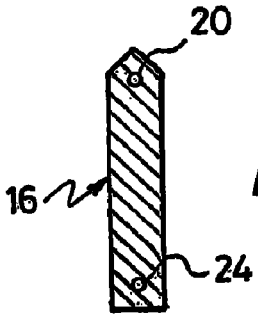
Figure 5:
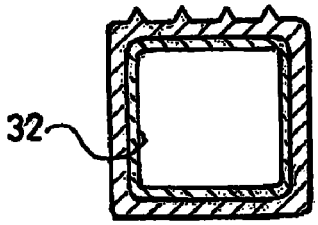
Figure 6:
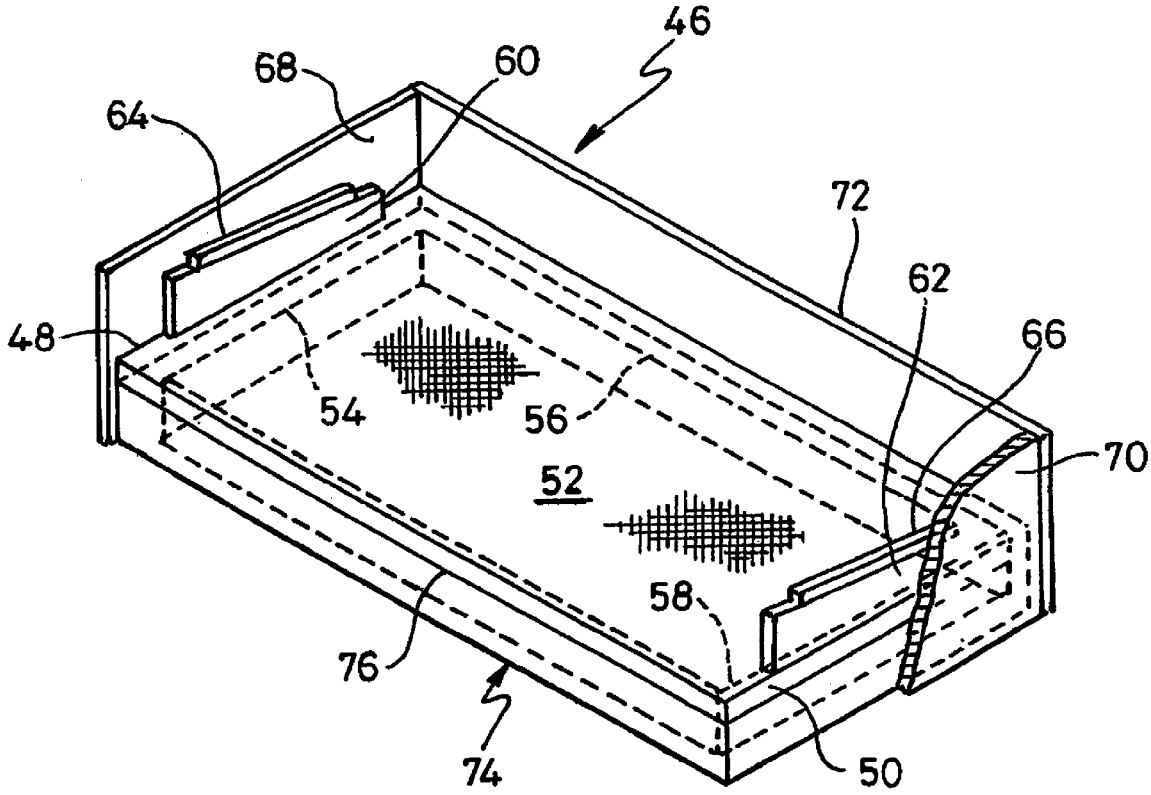
Figure 7:
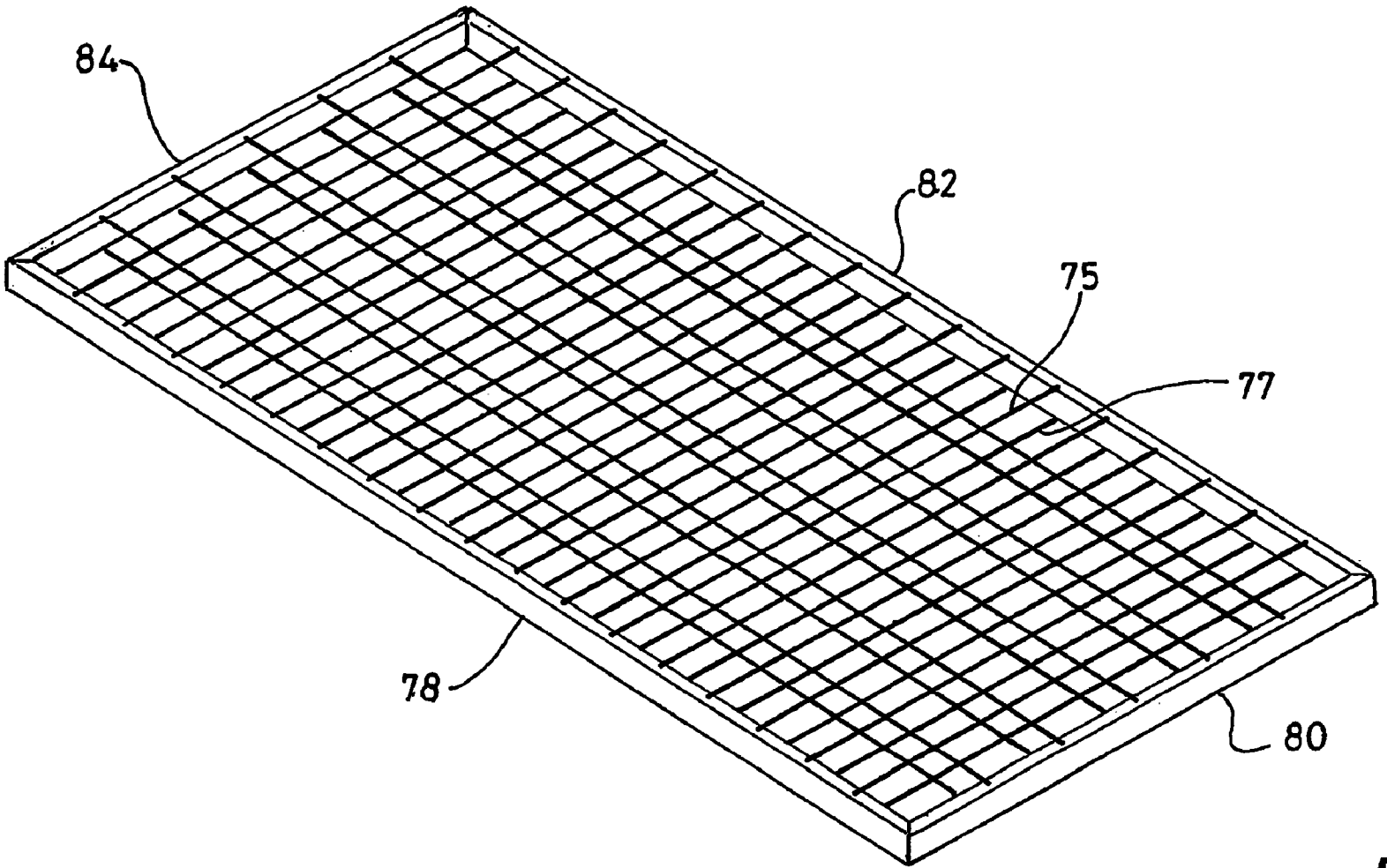
Figure 8:
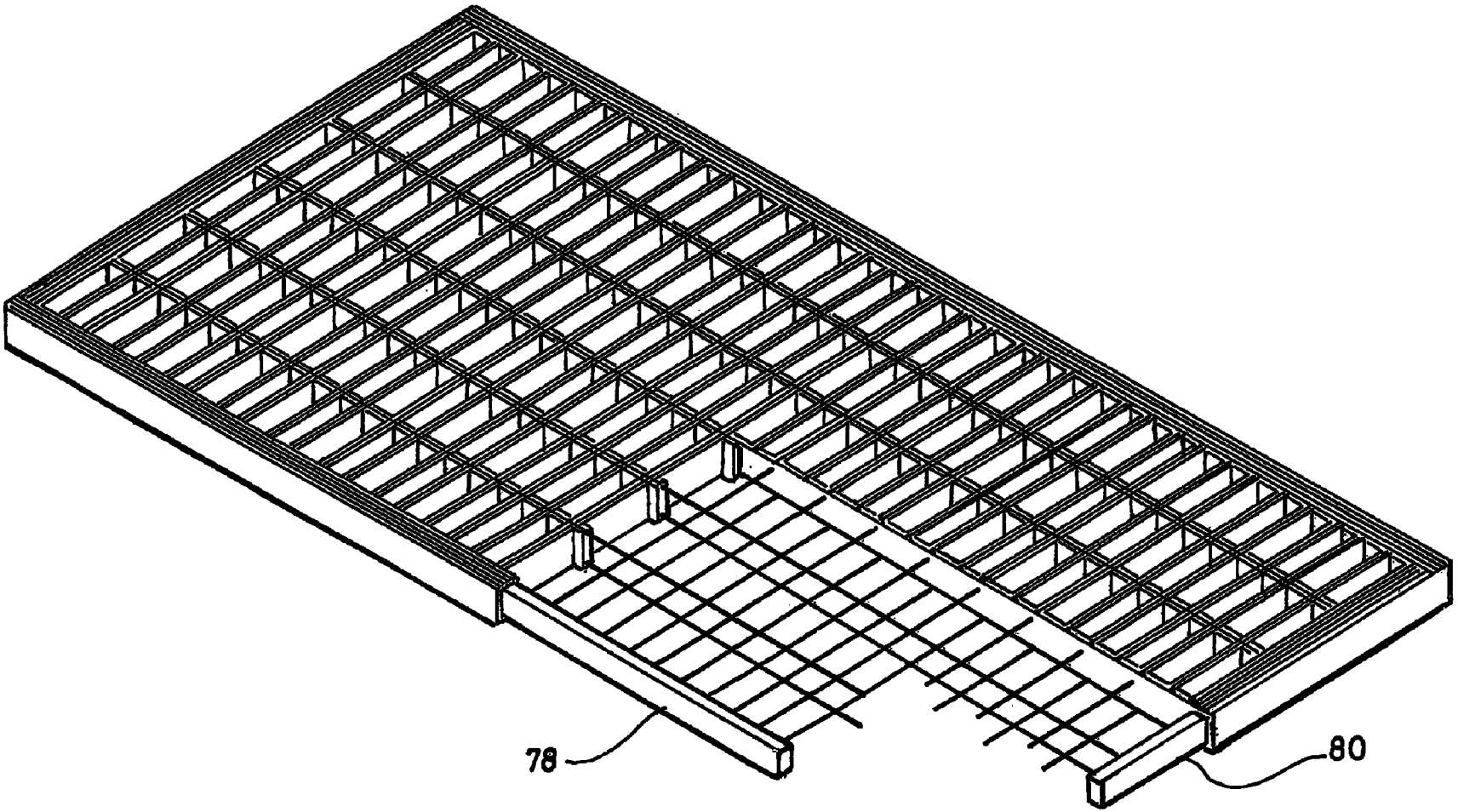
Figure 9:
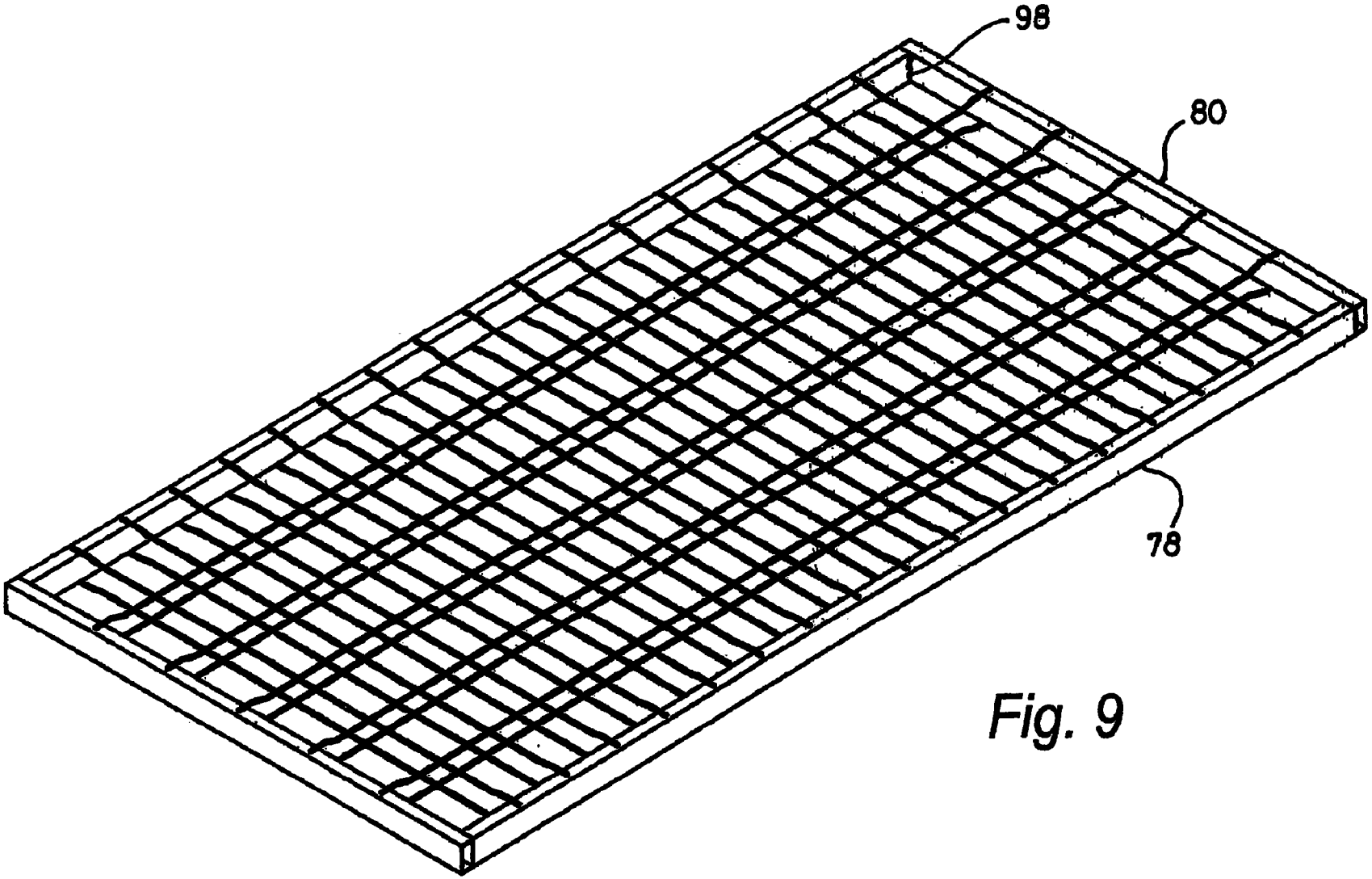
Figure 10:
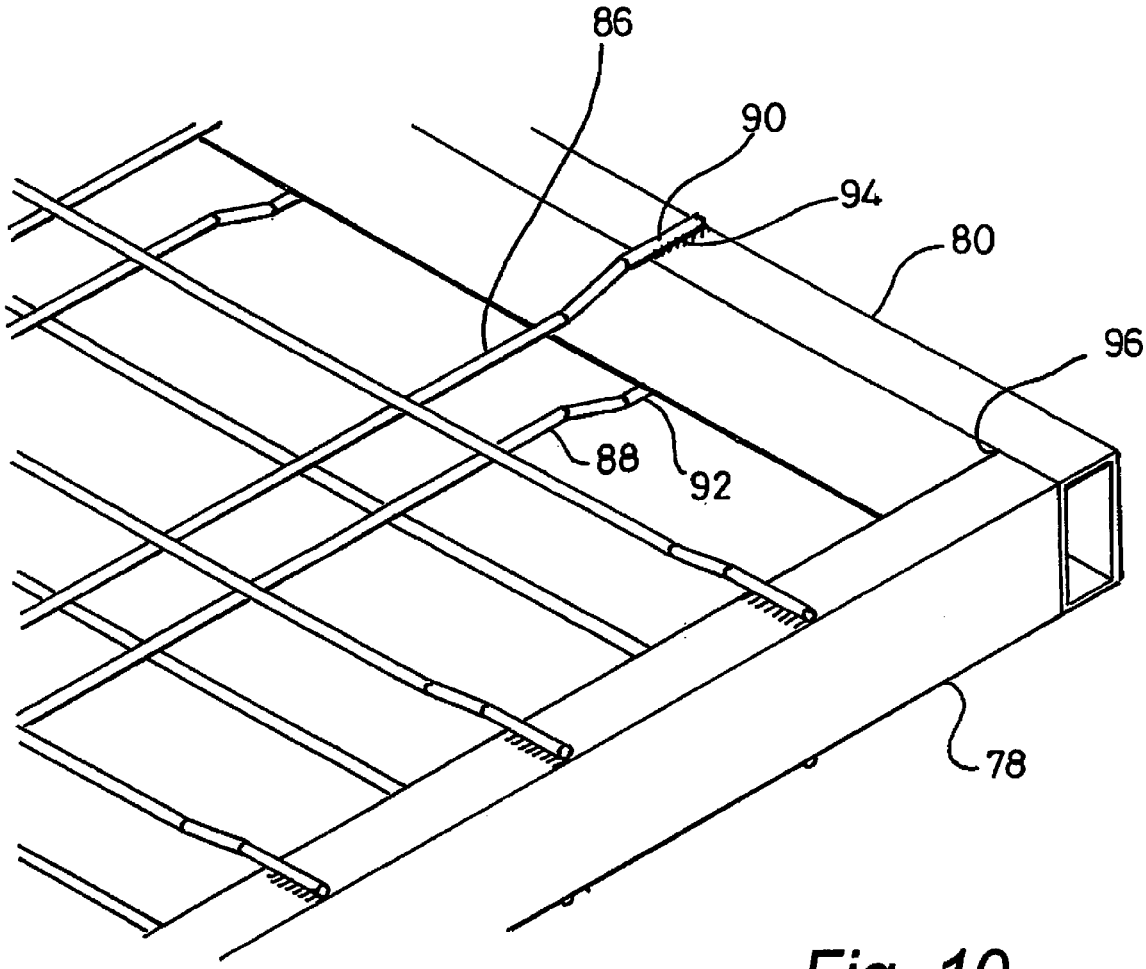
Figure 11:
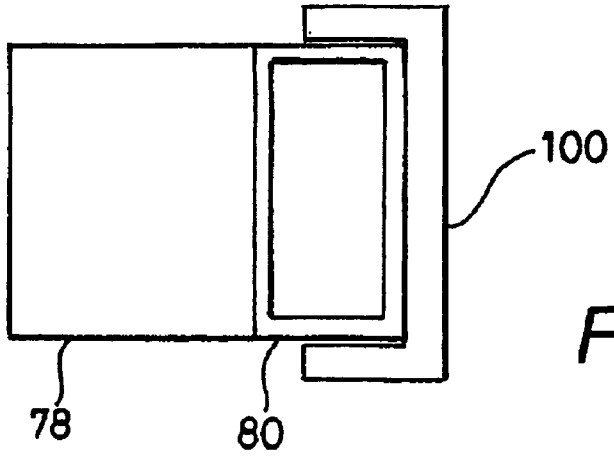
Figure 12:
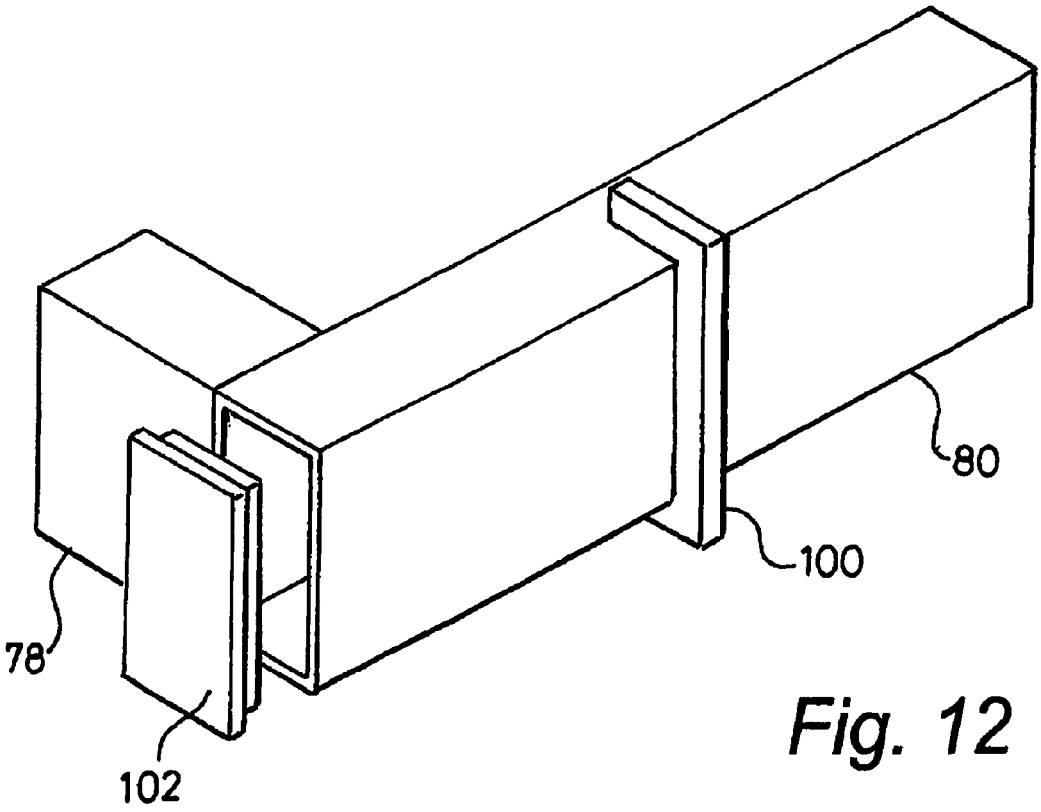
Figures 13, 14, 15, 16:
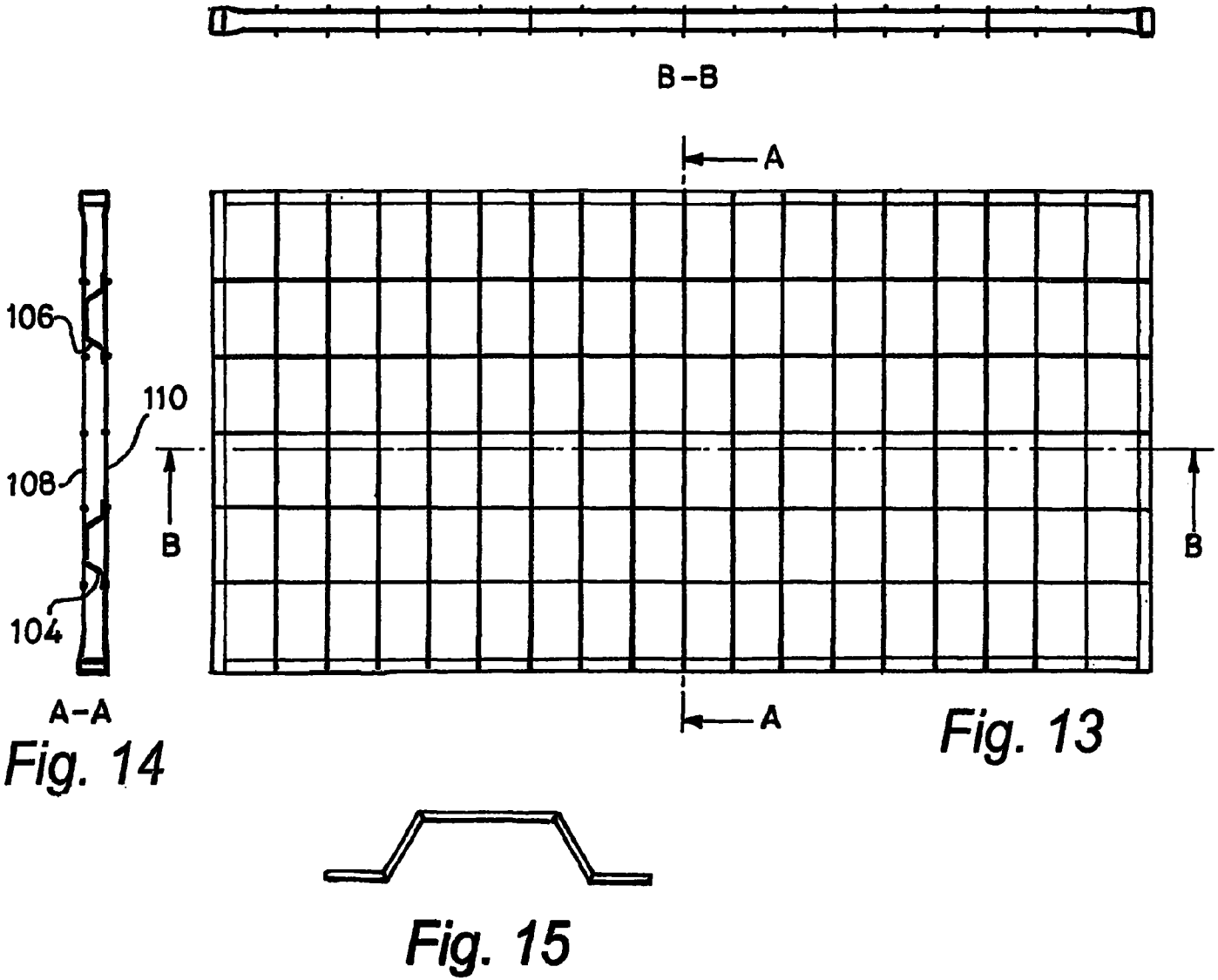
FIG. 16 shows an arrangement in which the spacers are located between only the third, sixth, ninth etc., pairs of wires.
Figure 18:
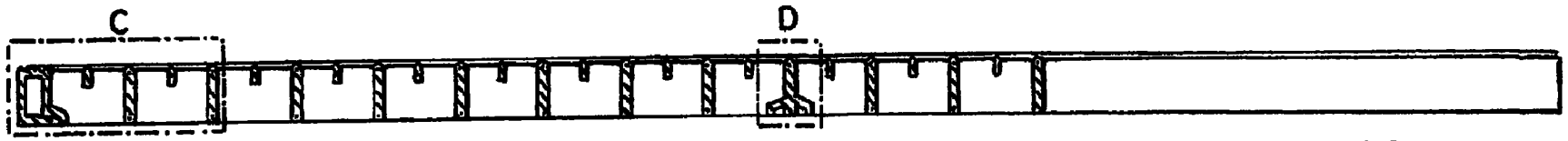
Figure 19:
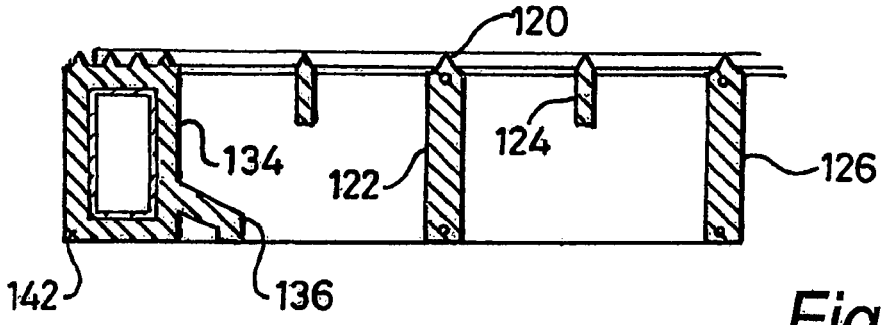

The ridges can also be seen in FIGS. 18 and 19 as can also ridges such as 120 along the upper edges of the ribs such as 122, into which wire mesh is also embedded at the same time as it is embedded in the ridges 112, 114 etc.

FIG. 19 also shows how material and weight can be saved by providing non-reinforced half-height ribs such as 124 between full height reinforced ribs such as 122, 126.

Figure 20:
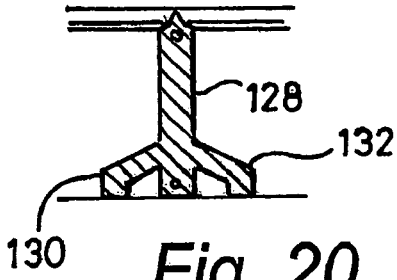

FIG. 20 shows how the foot of the middle ribs 120 can be formed with slanting protrusions 130, 132 on opposite faces thereof. Similar protrusions can be provided on the inner face of each of the two ends of the frame, one of which is shown at 134, in FIG. 19 with its protrusion denoted by 136.

Figure 17:
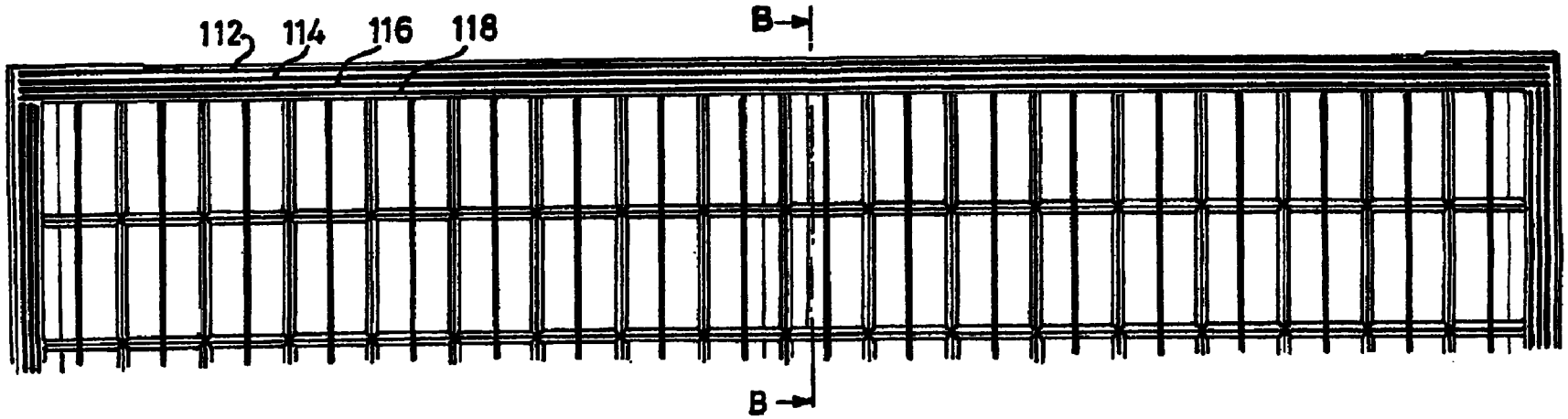
FIG. 17 shows the top of part of the eventual frame after the wires and box-section parts have been encapsulated in GRP by moulding. Ridges 112, 114, 116, 118 are formed along the upper surfaces of each of the box-section reinforced edges of the frame into which wire mesh is embedded during the next stage of manufacture to convert the frame to a screen.
Figure 21:
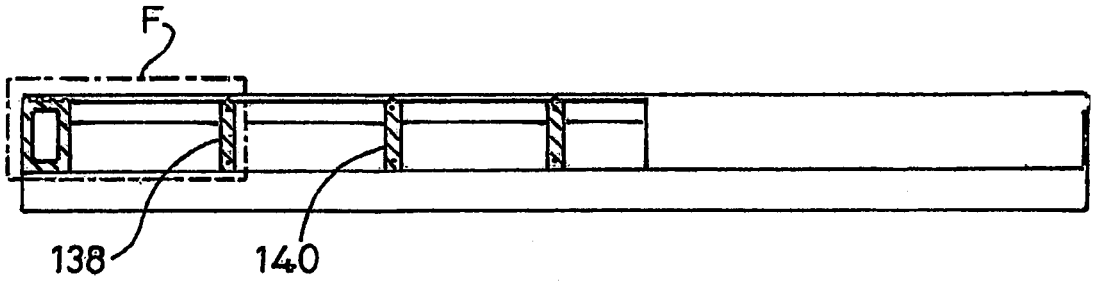
Figure 22:
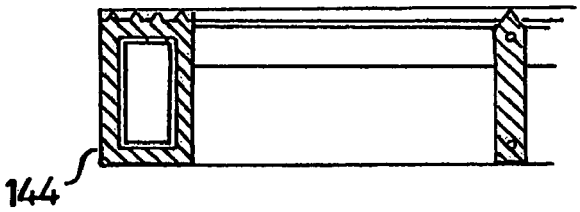

FIG. 21 is another cross-section through the finished moulded frame of FIG. 17 but at right angles to that of FIG. 18, and shows how all the moulded ribs 138, 140 etc., (which are orthogonal to the ribs such as 122) are full height ribs and fully reinforced. FIG. 22 merely shows the left hand end region, denoted F, in greater detail.

The encapsulating material surrounding the box-section parts can be seen at 142 and 144 in FIGS. 19 and 22.

The invention claimed is:

1. A frame over which woven wire mesh is to be stretched and secured to form a sieving screen which can be used to screen solids from drilling mud recovered from down-hole when drilling for oil or gas comprising a rectilinear moulded plastics frame having edge regions by which it is secured in place in a shaker and defining a plurality of rectilinear windows formed by an orthogonal array of intersecting ribs also of moulded plastics material at least some of which are internally reinforced by a structure comprising two spaced apart layers of orthogonal intersecting spaced apart wires, running parallel to the length and breadth of the rectilinear shape of the frame within the ribs to increase their rigidity, wherein:

1) the edge regions of the frame are reinforced internally by metal box-section members joined at their four corners and defining a perimeter reinforcement and 2) the ends of the wires are secured to the box-section member, and wherein the ends of the two layers of wires are secured to the upper and lower faces of the perimeter reinforcement.

2. A frame as claimed in claim 1 wherein the box-section members are encapsulated in the same plastics material from which the orthogonal array of intersecting ribs are moulded.

3. A frame as claimed in claim 1 wherein every other rib is not reinforced with wires.

4. A frame as claimed in claim 3 wherein every other rib that is not reinforced extends partway between the upper and lower faces of the frame.

5. A frame as claimed in claim 1 wherein lengths of wire bent to form spacers and adapted to fit between upper and lower wires of the rib reinforcing structure are joined to the upper and lower wires so as to extend therebetween and maintain the desired separation of the two layers of wires during the plastics encapsulation/moulding process.

6. A frame as claimed in claim 5 wherein the spacers are welded to the wires.

7. A frame as claimed in claim 5 wherein the spacers are wholly contained within the plastics material which form the ribs.

8. A frame as claimed in claim 1 wherein the box-section members of the perimeter reinforcement have a square cross section.

9. A frame as claimed in claim 1 wherein the box-section members of the perimeter reinforcement have a rectangular cross-sections.

10. A screen constructed from a frame as claimed in claim 1 and at least one layer of woven wire stretched over and secured to the upper surface of the frame so that tension is maintained in the wire cloth at the end of the manufacturing process.

11. A screen as claimed in claim 10 when fitted in a shaker wherein the screen is clamped in position in a shaker basket using a pneumatic seal or by wedges driven into position between abutments protruding internally from the shaker basket and the upper face of edge regions of the screen.

* * * * *